United States Patent [19]

Wortley et al.

[11] 4,362,253

[45] Dec. 7, 1982

[54] TAMPER PROOF CLOSURE

[75] Inventors: Michael Wortley, Waterlooville; Michael Hughes, Denmead; Robert Povey, Eastleigh, all of England

[73] Assignee: Cope Allman Plastics Limited, England

[21] Appl. No.: 326,118

[22] Filed: Nov. 30, 1981

Related U.S. Application Data

[63] Continuation of Ser. No. 183,647, Sep. 3, 1980, abandoned.

[30] Foreign Application Priority Data

Sep. 4, 1979 [FR] France ..... 79 22059

[51] Int. Cl.[3] ..... B65D 17/40

[52] U.S. Cl. ..... 220/276; 215/253; 215/256

[58] Field of Search ..... 215/253, 254, 256; 220/266, 270, 276

[56] References Cited

U.S. PATENT DOCUMENTS 2,772,802 12/1956 Woydatt et al. ..... 215/256

3,300,073 1/1967 Benz ..... 215/256 X 4,200,196 4/1980 Bashour ..... 215/253

FOREIGN PATENT DOCUMENTS 1247317 of 0000 United Kingdom .

1265477 of 0000 United Kingdom .

1335722 of 0000 United Kingdom .

1478558 of 0000 United Kingdom .

*Primary Examiner*—George T. Hall

*Attorney, Agent, or Firm*—Fisher, Gerhardt, Crampton & Groh

[57] ABSTRACT

A re-closable tamper-proof closure assembly for containers comprises a cap with a tamper-proof strip attached to the skirt of the cap by a breakable web but the strip is free of any tabs graspable by the user's hand, and is broken away from the cap simply by the act of removing the cap by pushing upwards on a stout lug. There may be a gap in the web already in the region of the lug, and at the opposite side of the cap the skirt is extended downwards to form a tongue between the ends of the strip. There can be a bead on the container neck for snap engagement of the cap on re-use, in addition to the bead engaged by the tamper-proof strip.

5 Claims, 7 Drawing Figures

TAMPER PROOF CLOSURE

This application is a continuation of application Ser. No. 183,647, filed 9-3-80 now abandoned.

This invention relates to tamper-proof closures for containers, such as may be used for foodstuffs, medical and cosmetic materials, cleaning materials, and in fact for any product where it is desirable for the purchaser or user to know, when he first opens the container, that the product has not been sampled or tampered with.

One well known form of tamper-proof closure comprises a moulded plastics cap with a tear-off strip extending around its skirt and engaging under a bead on the outside of the neck of the container. A tab is provided at some point on the strip for the user to grasp and pull, tearing the strip away from the skirt of the cap, to which it is joined by a thin web or series of spaced webs with gaps between them. The user can them remove the cap in the usual way, as a separate step. Where the cap is a straightforward push-on cap it may thereafter be held simply by friction, or there could be an inwardly directed bead, or series of circumferentially spaced beads, on the skirt of the cap, engaging under the above-mentioned bead on the neck of the container, or under a second bead, arranged above that which was engaged by the tamper-proof strip. The cap can then be snapped onto and off the container as often as desired, after removal of the tamper-proof strip.

In the case of screw caps it is known to provide a tamper-proof strip in the form of a complete ring with no finger tab, joined to the skirt of the cap by a weakened web or series of spaced webs, and the act of unscrewing the cap on the first occasion of use snaps the weakened web. The ring is thereafter left on the neck of the container, which has drawbacks from the point of view of hygeine and cleanliness.

The aim of the present invention is to provide a tamper-proof snap-on closure assembly in which integrity is clearly evident until first use but in which the first opening can be performed in a single operation and with the minimum of trouble, and leaving no unsightly or hygeinically dangerous loose strip on the neck of the container.

According to the invention there is proposed a recloseable tamper-proof snap-on closure assembly comprising a closure cap having a peripheral skirt and a tamper-proof strip below the skirt and joined to the skirt by a circumferentially extending weakened breakable web, the strip being free of any graspable finger tab, and a co-operating container neck onto which the cap fits, the neck being provided with an external circumferentially extending bead, or series of circumferentially spaced beads, under which the strip engages when the cap is in place, the cap proper being provided with an outwardly extending finger-engageable lug allowing a user to push upwards on that region of the cap that carries the lug, thereby separating the cap from the strip initially in that region, and the arrangement being such that continued upwards pressure on the lug flexes the cap and progressively tears the web until the cap and tamper-proof strip are both free of the container neck.

Thus a single operation by the user breaks the tamper-proofing and releases the cap. The closure is preferably a plastics moulding. The strip preferably does not extend around to form a continuous ring of uniform thickness but is interrupted at a circumferential region on the opposite side of the cap from the lug. According to a further feature of the invention there is a gap in the strip in this region, and the skirt of the cap extends downwards in the form of a tongue, the sides of which are joined to the ends of the strip by breakable webs. In practice, when such a cap is removed, the strip may remain attached to the cap at one or the other of its ends, and is then easily detached and disposed of.

Perferably the neck of the container has a second circumferential bead, or series of beads, above the first to provide snap engagement of the cap onto the neck on subsequent re-use.

Preferably also, according to a further feature of the invention, the circumferentially extending web is interrupted in the region of the lug so that in this region there is already a gap between the skirt of the cap and the strip, facilitating the start of the tearing action.

The invention will now be further described by way of example with reference to the accompanying drawings, in which.

Figure 1:
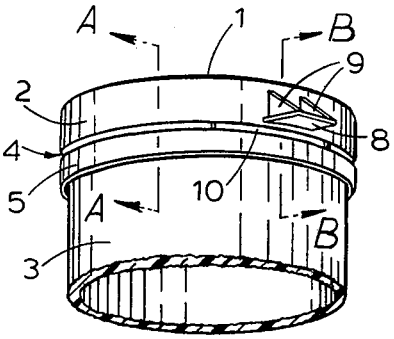
FIG. 1 is a three-quarter perspective view from below of the upper part of a container fitted with a closure according to the invention.
Figure 2:
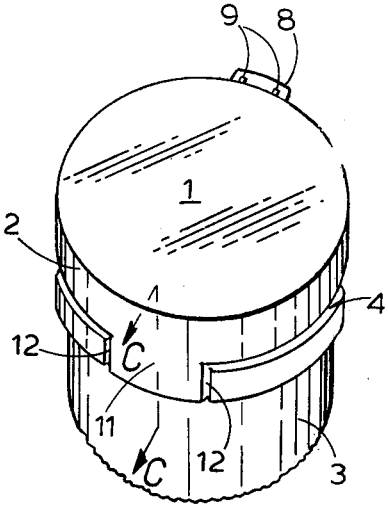
FIG. 2 is a three-quarter perspective view from above, from a different view point.
Figure 3:
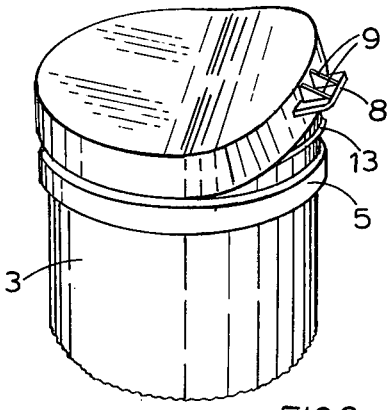
FIG. 3 shows the cap partially removed.
Figure 4:
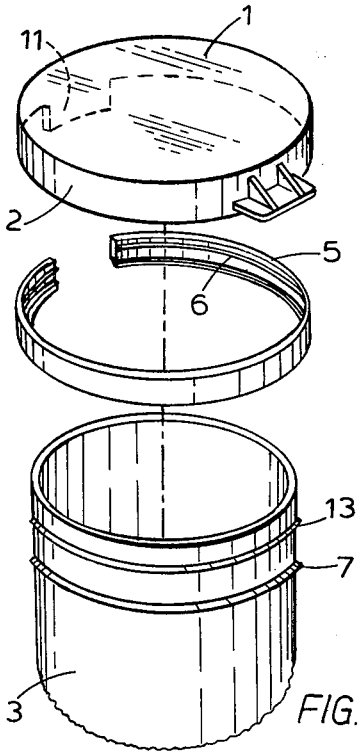
FIG. 4 shows the cap and container after removal of the cap.
Figure 5:
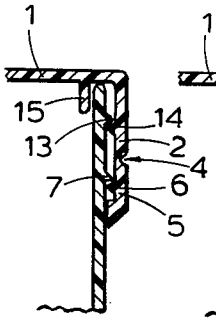
FIG. 5 is a section to a larger scale through the cap and container on the line A—A in FIG. 1.

The closure assembly comprises a plastics cap 1, having a skirt 2 co-operating with a container neck 3. Initially the lower edge of the skirt 2 is joined by a thin breakable circumferentially extending web 4 (FIG. 5) to a circumferentially extending tamper-proof strip 5. When the cap is on the container a bead 6 extending around the inside of the strip 5 engages under a continuous circumferentially extending bead 7 on the outside of the neck of the container and prevents the cap being removed. It will be seen that the bead 7 is of saw-toothed profile, with its upper face inclined and its lower face square, so that the bead 6 can be forced past the bead 7 when the cap is first fitted onto the container but cannot thereafter be forced past it in the opposite direction.

Figure 6:
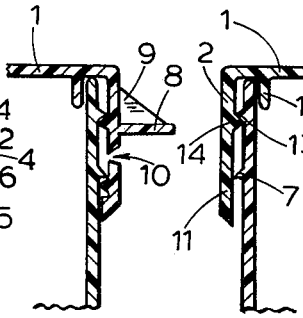
FIG. 6 is a section through the cap and container on the line B—B in FIG. 1.
Figure 7:
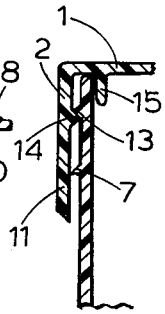
FIG. 7 is a section through the cap and container on the line C—C in FIG. 2.

A stout lug 8 projects radially from one point on the lower edge of the skirt 2, and is further stiffened by the provision of a pair of integral struts 9. It is important to note that, in the region below the lug 8 and for a short distance to each side of it, the thin web 4 is interrupted, so that there is a clear gap 10 (see FIG. 6) between the skirt 2 and the strip 5 in this region.

In the region diametrically opposite the lug 8 the strip 5 itself is interrupted, and the gap between the two ends is occupied by a tongue 11 forming a downward extension of the skirt 2 in this region; the sides of the tongue are joined to the ends of the strip 5 by breakable webs 12 forming continuations of the web 4.

A second circumferentially extending bead 13, a short way above the bead 7, on the outside of the neck of the container, is engaged by a bead 14 on the inside of the skirt 2 so as to retain the cap on the neck by snap engagement on re-closing after removal of the tamper-proof strip.

To remove the cap on the first occasion on which the container is to be used, the user applies a finger or thumb under the lug 8 and pushes firmly upwards. Because the web 4 is interrupted at this point he is able to force this part of the cap upwards. The resultant movement applies a concentrated tensile stress to the adjacent regions of the web 4, making it relatively easy to tear the web, and as the cap continues to be pushed upwards the tear is propagated around the web until it reaches the ends. The cap can then swing upwards, pivoting about approximately the lower end of the tongue 11, and breaking one or both of the end webs 12. Both the cap and the strip are now completely free from the container, without having required anything from the user beyond a straightforward upward push on the lug 8. If the strip 5 has not already fallen away from the cap 1 it can readily be detached by the user.

The cap can be subsequently replaced on the container, with snap engagement between the beads 13 and 14, and removed as often as desired. In the example illustrated there is an internal fin 15 provided on the underside of the top wall of the cap 1 to engage inside the neck of the container, but this is not essential.

It is also not essential that any of the circumferentially extending beads referred to above should be continuous, as they could be interrupted by short gaps provided they are present to a sufficient extent to perform their functions. It will be noted that the strip 5 is free of any tabs, lugs or other projections for grasping by the user since the detachment of the strip requires no such grasping and on the contrary takes place automatically on first removal of the cap.

We claim:

1. A re-closable tamper-proof snap-on closure assembly comprising a closure cap, said cap having a peripheral skirt, a tamper-proof strip below said skirt and joined to said skirt by a circumferentially extending weakened breakable web, said strip being free of any graspable finger tab, and a co-operating container neck onto which said cap fits, said neck being provided with an external circumferentially extending bead formation under which said strip engages when said cap is in place, said cap being provided with an outwardly extending finger-engageable lug, a gap formed in said breakable web in the region of said lug allowing a user to push upwards on the region of the cap that carries said lug thereby separating said cap from said strip initially in said region at opposite sides of said gap, and the arrangement being such that continued upward pressure on said lug flexes said cap and progressively tears said web until said cap and tamper-proof strip are both free of said container neck.

2. The closure assembly set forth in claim 1 wherein said strip is interrupted in a region of said cap on the opposite side of said cap from said lug.

3. The closure assembly set forth in claim 2 including a tongue forming an extension of said skirt and projecting between the two ends of said strip where the latter is interrupted.

4. The closure assembly set forth in claim 3 wherein said ends of said strip are joined to said tongue by breakable webs.

5. The closure assembly set forth in claim 1 including a second circumferential bead formation on said container neck and an internal bead on said skirt of said cap co-operating with said second bead formation to provide a positive snap engagement between said cap and neck after removal of said strip.

* * * * *